US005975184A

United States Patent [19]

Nien et al.

[11] Patent Number: 5,975,184

[45] Date of Patent: Nov. 2, 1999

[54] DECORATIVE PLATE STRUCTURE ASSEMBLY FOR A BEAM OF A BLIND

[76] Inventors: Jerry Nien, No.45-4, Fan Po ST., Fu Hsing Hsiang, Changhua Hsien, Taiwan; Sherry Hsu, No.8, Lane 25, Yu Tsai ST., Ting Tsuo Li, Lu Kang Town, Changhua Hsien, Taiwan

[21] Appl. No.: 09/234,459

[22] Filed: Jan. 21, 1999

[51] Int. Cl.[6] ..... E04F 10/00

[52] U.S. Cl. ..... 160/38; 160/902

[58] Field of Search ..... 160/38, 39, 19, 160/902; 248/254, 262

[56] References Cited

U.S. PATENT DOCUMENTS

| | | | |
|---|---|---|---|
| 5,054,535 | 10/1991 | Rozon | 160/38 |
| 5,188,162 | 2/1993 | Simon et al. | 160/38 |
| 5,615,721 | 4/1997 | Winter | 160/38 |
| 5,660,219 | 8/1997 | Ford et al. | 160/38 |

FOREIGN PATENT DOCUMENTS

| | | | |
|---|---|---|---|
| 1048684 | 1/1959 | Germany | 160/38 |

*Primary Examiner*—Blair M. Johnson
*Attorney, Agent, or Firm*—Browdy and Neimark

[57] ABSTRACT

A decorative plate assembling structure for upper beam of a vertical/horizontal blind, including an upper beam, two sealing caps, two sealing covers, a left and a right decorative plates and multiple intermediate decorative plates. The upper beam has a U-shaped cross-section. An upper and a lower sides of a front end of the sealing cap are respectively disposed with two L-shaped insertion channels. An upper and a lower ends of the sealing cover are respectively disposed with two L-shaped insertion sections for fitting into the L-shaped insertion channels of the sealing cap. A boss outward projects from a center of the sealing cover. A dovetail block is disposed at an end of the boss. A back side of each of the left and right decorative plates is disposed with a transverse dovetail channel. A back side of each intermediate decorative plate is disposed with a fastener member. The whereby the dovetail channels of the left and right decorative plates are fitted with the dovetail blocks of the bosses of the sealing covers, permitting the left and right decorative plates to be replaceably slidably located on the upper beam, the fastener member of the intermediate decorative plate clipping a front side of the upper beam, permitting the intermediate decorative plate to be replaceably slidably located on the upper beam. The decorative plates are freely replaceably and movably located on the upper beam to beautify the same.

3 Claims, 5 Drawing Sheets

DECORATIVE PLATE STRUCTURE ASSEMBLY FOR A BEAM OF A BLIND

BACKGROUND OF THE INVENTION

The present invention relates to a decorative plate assembling structure for an upper beam of a vertical/horizontal blind, in which decorative plates replaceably and movably assembled with the upper beam to beautify the upper beam and make the upper beam more valuable.

A conventional blind includes an upper beam on which the slats are hung. The upper beam is not equipped with any decorative accessory so that the appearance of the upper beam is monotonous and can hardly achieve a beautiful visual appearance.

SUMMARY OF THE INVENTION

It is therefore a primary object of the present invention to provide a decorative plate assembling structure for an upper beam of a vertical/horizontal blind. A left and a right decorative plate is replaceably fitted with two ends of the upper beam and multiple intermediate decorative plates are replaceably fitted with a middle section of the upper beam. Therefore, the upper beam is beautified and becomes more valuable.

It is a further object of the present invention to provide the above decorative plate assembling structure in which the decorative plates are replaceable so that a consumer can freely select various types of decorative plates according to personal desire or indoor decoration for achieving a visual change.

The present invention can be best understood through the following description and accompanying drawings, wherein:

DETAILED DESCRIPTION OF THE PREFERRED EMBODIMENT

Figure 1:
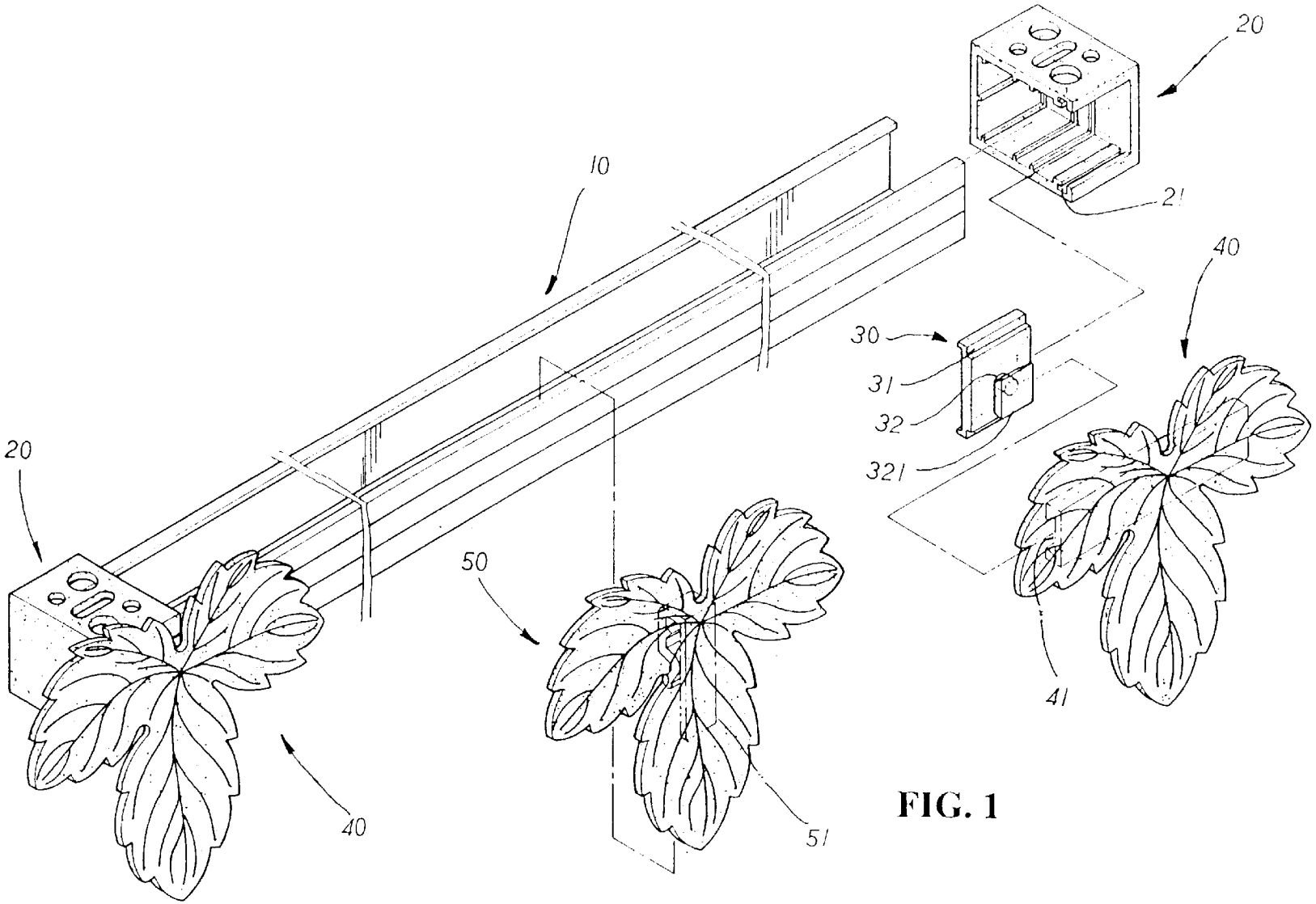
FIG. 1 is a perspective exploded view of the present invention.

Please refer to FIG. 1. The present invention includes an upper beam 10, two sealing caps 20, two sealing covers 30, a left and a right decorative plates 40 and multiple intermediate decorative plates 50. The upper beam 10 has a U-shaped cross-section. An upper and a lower sides of a front end of the sealing cap 20 are respectively disposed with two L-shaped insertion channels 21. The upper and lower ends of the sealing cover 30 are respectively disposed with two L-shaped insertion sections 31. A boss 32 projects outwardly from the center of the sealing cover 30. A dovetail block 321 is disposed at the end of the boss 32. A back side of each of the left and right decorative plates 40 is disposed with a transverse dovetail channel 41. A back side of the intermediate decorative plate 50 is disposed with a substantially R-shaped fastener member 51 at a certain height.

Figure 5:
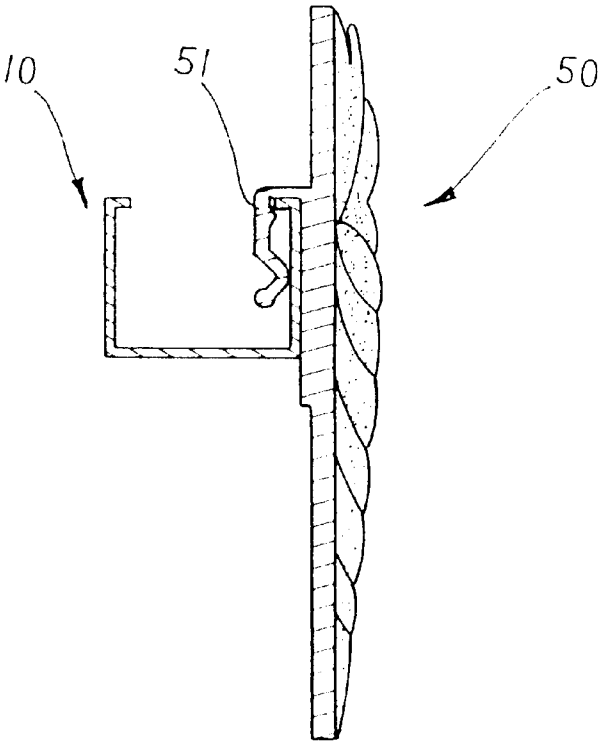
FIG. 5 is a sectional view showing that the intermediate decorative plate is fastened on the upper beam by the fastener member of the present invention.
Figure 2:
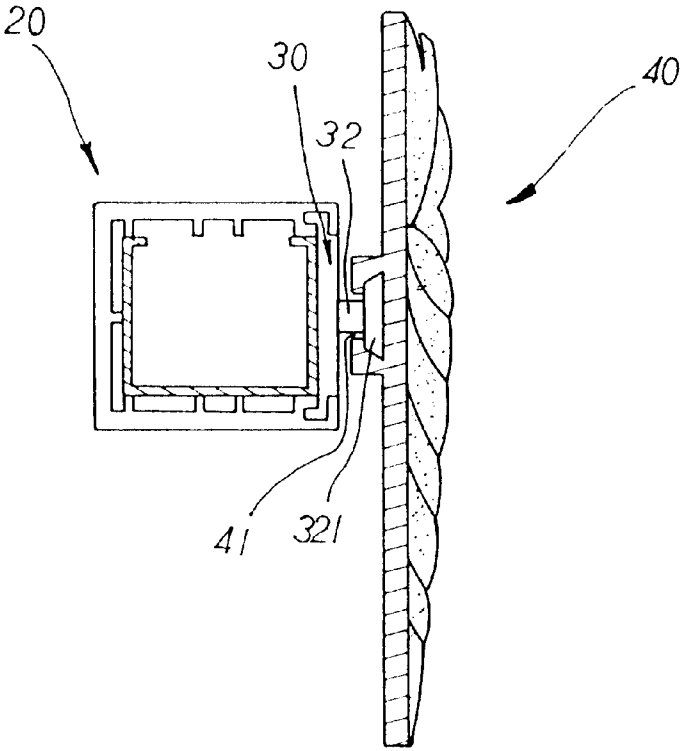
FIG. 2 is a sectional view showing that the left and right decorative plate are fitted with two ends of the upper beam of the present invention.
Figure 3:
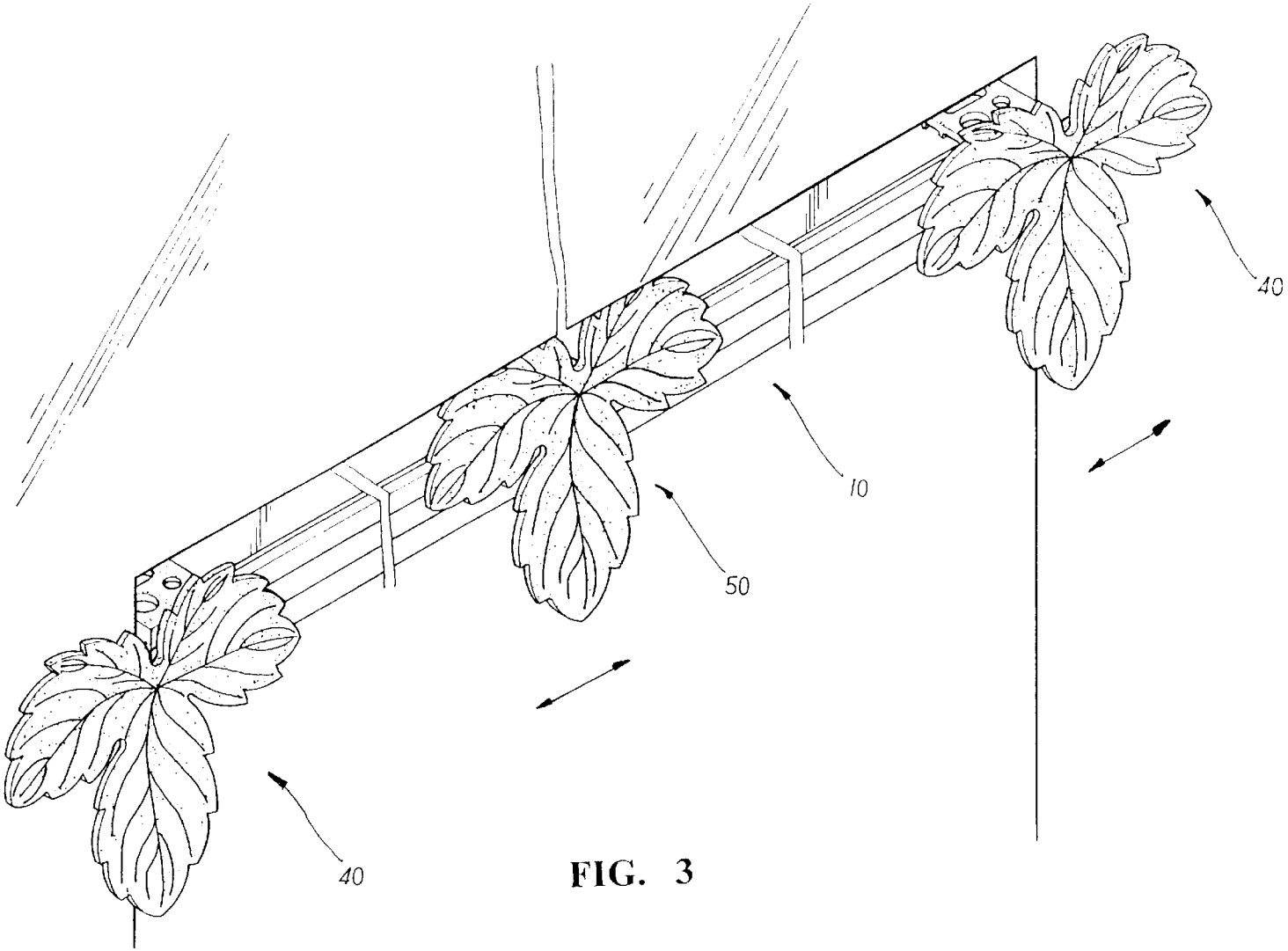
FIG. 3 is a perspective view showing that the upper beam is installed under an upper end of a window and also showing the adjustment and sliding of the decorative plates along the upper beam.
Figure 4:
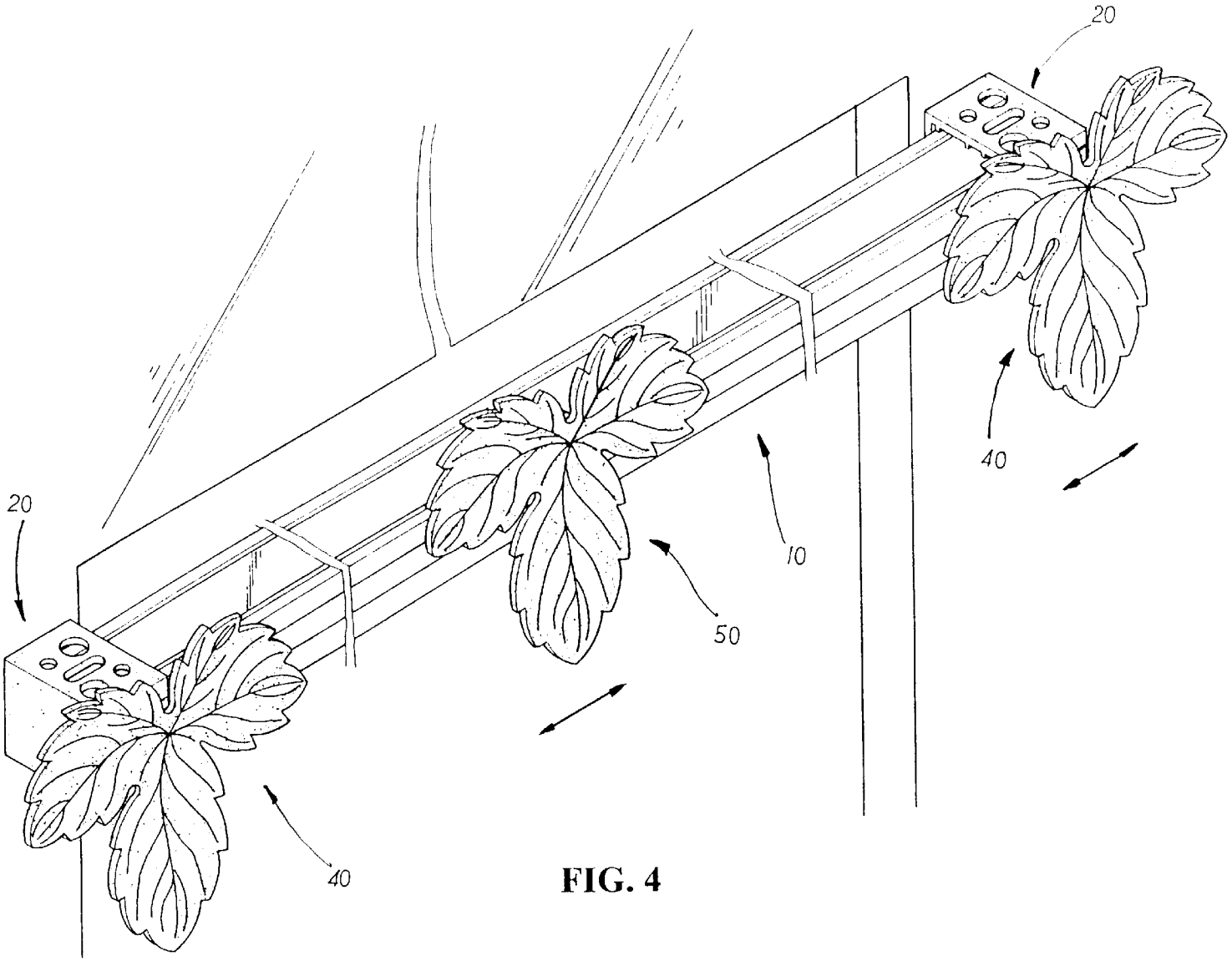
FIG. 4 is a perspective view showing that the upper beam is installed on a wall above a window and also showing the adjustment and sliding of the decorative plates along the upper beam.

Referring to FIG. 2, when assembled, the L-shaped insertion sections 31 of the sealing covers 30 are first fitted into the L-shaped insertion channels 21 of the sealing caps 20 to form a sealing cap 20 with an open face. Then the sealing caps 20 with their open faces facing the upper beam 10 are fitted with left and right ends of the upper beam 10. Furthermore, the dovetail channels 41 of the left and right decorative plates 40 are fitted with the dovetail blocks 321 of the bosses 32 of the sealing covers 30 with a certain frictional force existing therebetween, whereby the decorative plates 40 is slidably located on the upper beam 10. FIG. 3 shows that the upper beam of the present invention is installed under upper side of a window. FIG. 4 shows that the upper beam is installed on a wall above the window. In either the case that the upper beam 10 is installed under upper side of the window or the case where the upper beam 10 is installed on the wall above the window, the mounting and sliding of the decorative plates 40 will not be affected and limited by the lateral walls. FIG. 5 shows that the intermediate decorative plate is fastened on the upper beam. The fastener member 51 of the intermediate decorative plate 50 clips on a front side of the upper beam 10 from an upper side to a lower side with a certain frictional force existing between the fastener member 51 and the upper beam 10. Therefore, the intermediate decorative plate 50 is slidably located on the upper beam 10.

Figure 6:
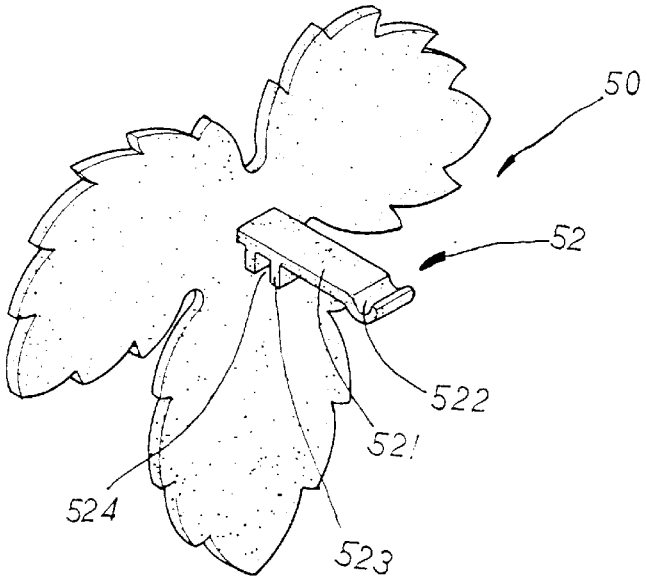
FIG. 6 is a perspective view of another embodiment of the present invention.
Figure 7:
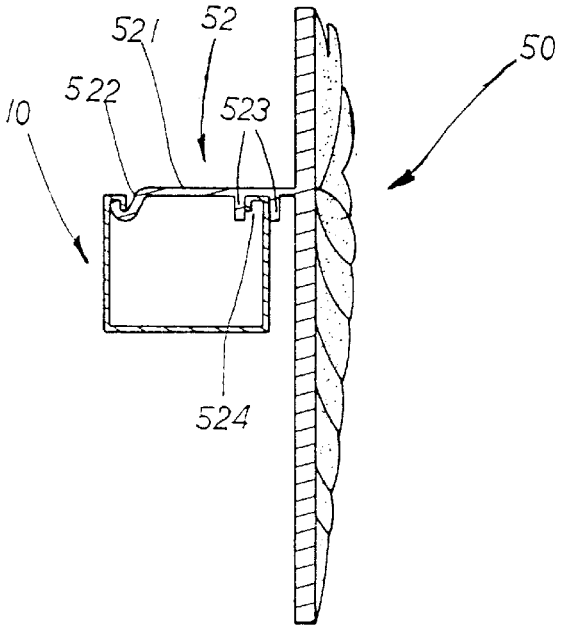
FIG. 7 is a sectional assembled view of the other embodiment of the present invention.

FIGS. 6 and 7 show another embodiment of the present invention, in which the fastener member of the intermediate decorative plate 50 is formed as a latch hook 52. The latch hook 52 is formed as a plate body 521. A free end of the plate body 521 is formed with a C-shaped hook body 522. A bottom face of a fixed end of the plate body 521 is formed with two downward extending clamping plates 523 defining therebetween a clamping space 524. The hook body 522 of the latch hook 52 is hooked in a rear upper edge of the upper beam 10. The two clamping plates 523 serve to fixedly clamp a front upper edge of the upper beam 10 with the front upper edge received in the clamping space 524.

According to the above arrangement, the present invention has the following advantages:

1. The decorative plates 40, 50 beautify the upper beam 10 and make the upper beam more valuable.

2. The decorative plates 40, 50 are replaceable so that a consumer can freely select various types of decorative plates 40, 50 according to personal desire or indoor decoration for achieving a visual change.

The above description and accompanying drawings are only used to illustrate some embodiments of the present invention. Any modification or variation derived from the embodiments should fall within the scope of the present invention.

What is claimed is:

1. A decorative plate structure assembly for a beam of a blind, said beam having a U-shaped cross-section, said decorative plate structure assembly comprising:

two end sealing caps adapted for engagement to opposite ends of said beam, two sealing cap covers, two end decorative plates, and a plurality of intermediate decorative plates, an upper and lower edge of each of the two sealing caps having a L-shaped insertion channel, an upper and lower end of each of the two sealing cap covers having a L-shaped insertion section for engagement with a corresponding L-shaped insertion channel, a boss projecting outward from a center of each of the two sealing cap covers, a dovetail block being disposed at an end of the boss, a transverse dovetail channel disposed on a back side of each of said two end decorative plates, and each of said plurality of intermediate decorative plates having a fastener member on a back side thereof for engagement on said beam, wherein each dovetail channel of the two end decorative plates are respectively slidably engaged on each said dovetail block to permit use of different decorative plates and said plurality of intermediate decorative plates can be clipped on said beam for slidable engagement and replacement.

2. A decorative plate assembling structure as claimed in claim 1, wherein a frictional force exists between each dovetail channel and dovetail block when engaged, permitting the two end decorative plates to be slidably located on the beam and a frictional force exists between the fastener member and the beam, permitting each of the plurality of intermediate decorative plates to be slidably located on the beam.

3. A decorative plate assembling structure as claimed in claim 1, wherein the fastener member of the back side of the plurality of intermediate decorative plates is a latch hook formed as a plate body, a free end of the plate body being formed with a C-shaped hook body, a bottom face of a fixed end of the plate body being formed with two downward extending clamping plates, whereby the hook body is adapted to be hooked in a rear upper edge of the beam while the two clamping plates are adapted to fixedly clamp a front upper edge of the beam, permitting the decorative plate to be freely replaceable and moveable on the beam.

* * * * *